US006035865A

United States Patent [19]

Krieger

[11] Patent Number: 6,035,865

[45] Date of Patent: Mar. 14, 2000

[54] COSMETIC HOLDER ASSEMBLY

[76] Inventor: Heidi Lee Krieger, 269 Vanderbilt Blvd., Oakdale, N.Y. 11769

[21] Appl. No.: 09/277,917

[22] Filed: Mar. 29, 1999

[51] Int. Cl.[7] ..... A45D 33/24; A45D 33/26

[52] U.S. Cl. ..... 132/294; 132/293; 206/581

[58] Field of Search ..... 132/294, 293, 132/297, 300, 301, 304, 314, 318, 303, 317; 206/541, 501, 581, 823; 401/18, 23, 34, 57, 35; 220/23.4, 23.83, 4.27, 4.26, 23.6, 6; 446/125, 127

[56] References Cited

U.S. PATENT DOCUMENTS

| | | | |
|---|---|---|---|
| D. 157,468 | 2/1950 | Burger | 446/125 |
| D. 321,717 | 11/1991 | Hager | 401/18 |
| 2,631,747 | 3/1953 | Stolte | 446/125 |
| 2,691,184 | 10/1954 | Miller et al. | 132/294 |
| 3,346,908 | 10/1967 | Johnson | 132/320 |
| 3,363,968 | 1/1968 | Williams | 132/320 |
| 3,369,658 | 2/1968 | HasselMann | 220/23.83 |
| 4,150,089 | 4/1979 | Linet | 422/102 |
| 4,189,057 | 2/1980 | Morille | 220/23.4 |
| 4,196,808 | 4/1980 | Pardo | 206/432 |
| 4,235,343 | 11/1980 | Thompson | 215/6 |
| 4,607,756 | 8/1986 | Courtman | 215/6 |
| 5,314,067 | 5/1994 | Strock | 220/23.83 |
| 5,887,740 | 3/1999 | Hong | 220/4.27 |

*Primary Examiner*—Gene Mancene
*Assistant Examiner*—Pedro Philogene
*Attorney, Agent, or Firm*—Davis and Bujold

[57] ABSTRACT

A cosmetic holder assembly for detachably supporting a plurality of separate cosmetic containers. Each one of the separate cosmetic containers is provided with an internal cavity for housing a desired cosmetic container or a cosmetic and an application for facilitate dispensing of the cosmetic. Each one of the plurality of containers are releasable supported by the support member preferably by a frictional-fit engagement.

20 Claims, 5 Drawing Sheets

COSMETIC HOLDER ASSEMBLY

FIELD OF THE INVENTION

The present invention related to a cosmetic holder assembly for housing a plurality of cosmetics and/or cosmetic applicators. More particularly, the present invention relates to such a cosmetic holder having at least two separate containers for housing therein cosmetics such as, e.g., eyeliner, lipstick, mascara, eye shadow, perfume, cologne, lip liner, highlighter and the like.

DESCRIPTION OF THE PRIOR ART

Containers for housing cosmetics are well known in the art. Typically, while quite satisfactory in use, many containers housing cosmetics are inefficient because they occupy a significant amount of space and are not convenient to carry in a purse, a handbag or the like. Most women carry individual cosmetics loosely in their purse or handbag and, as a result, they waste valuable time searching through their purse or handbag looking for a particular cosmetic which is desired. So far as is known, there is not presently available a cosmetic arrangement or container for housing a plurality of cosmetics which is convenient and easy to use.

SUMMARY OF THE INVENTION

Wherefore, it is an object of the present invention to overcome the aforementioned problems and drawbacks associated with the prior art.

An object of the present invention is to provide a novel cosmetic holder which detachably supports a plurality of separate containers, each capable of housing a cosmetic, a perfume and/or a cosmetic applicator.

Another object of the present invention is to provide a cosmetic holder which allows the user to vary the size and shape of the cosmetic holder assembly, depending upon the application at hand, so that the cosmetic holder assembly can fit in most conventional purses or handbags.

Still another object of the present invention is to provide a cosmetic holder which allows the user to readily locate a particular cosmetic which is stored in a separate container to facilitate retrieval of the same.

Yet another object of the present invention is to provide a cosmetic holder having a plurality of separate containers for housing cosmetics which are each separately detachable and refillable.

A still further object of the present invention is to provide a cometic holder which is simple in design and relatively inexpensive to manufacture for widespread sale and use.

Another object of the present invention is to allow the user to create a unique color, hue, scent, fragrance, or smell by combining the application of two or more cosmetics to a user one after the other.

Certain of the foregoing and related objects are attained, according to the present invention, by the provision of a cosmetic holder assembly for housing a plurality of cosmetics and/or cosmetic applicators. The cosmetic holder assembly comprises a plurality of containers, a support member or base for detachably supporting the containers on the base. The containers can be of virtually any size and shape provided the base can detachably support a plurality of containers. Preferably, the base detachably supports a plurality of containers in a friction-fit manner. In particular, the base has a plurality of upright posts or projections extending from a top and/or bottom planar surface thereof. Each post or projection detachably receives thereon, a complimentary configured and dimensioned recess or bore formed within the base surface or wall of each container. A frictional engagement is formed between each post or projection and the complimentary recess or bore thereby detachably and securely attaching the container to the base Each container also has an outer end supporting a dispenser or a cap to enclose the outer end and allow dispensing of a cosmetic housed within the container. For example, a friction-fit cap is provided to enclose a container housing lipstick. Alternatively, an internally threaded cap having an applicator is provided to enclose a container housing eyeliner, for example. If desired, the outer end of the container can be provided with a convention pump style spray applicator.

The base can have a variety of different shapes and sizes, depending upon the particular application, for detachably supporting containers having a variety of different shapes and sizes. It is also desirable that the cosmetic holder assembly be manufactured from a conventional plastic, metal, glass or other materials which are well known in the art.

The present invention also relates to a cosmetic holder assembly for detachably supporting a plurality of separate cosmetic containers, said cosmetic holder assembly comprising: a plurality of separate containers each having a cavity sized for housing a desired cosmetic therein, and each cavity being closed at one end and having an opening at an opposite end thereof; each of said plurality of separate containers having a cap for releasably engaging with the opening and sealing the desired cosmetic within the cavity; and a first surface of each of said plurality of containers having a coupling member for facilitating releasable coupling of at least two of said plurality of separate containers with one another.

BRIEF DESCRIPTION OF THE DRAWINGS

These and other objects and advantages of the present invention will become apparent from the following description considered in connection with the accompanying drawings which disclose several embodiments of the present invention. It is to be understood that the drawings are to be used for the purpose of illustration only and not as a definition of the invention.

In the drawings, it is to be appreciated that similar reference numerals denote similar elements throughout the several views.

DETAILED DESCRIPTION OF THE PREFERRED EMBODIMENTS

Figure 1:
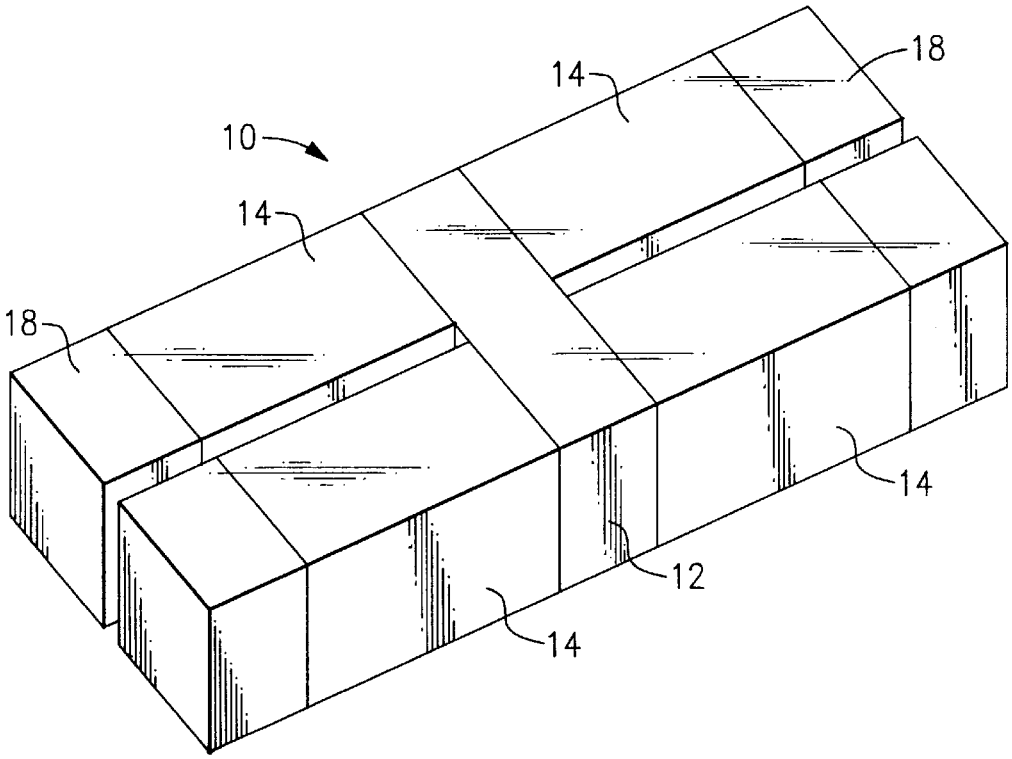
FIG. 1 is a perspective view of a cosmetic holder assembly embodying the present invention.
Figure 2:
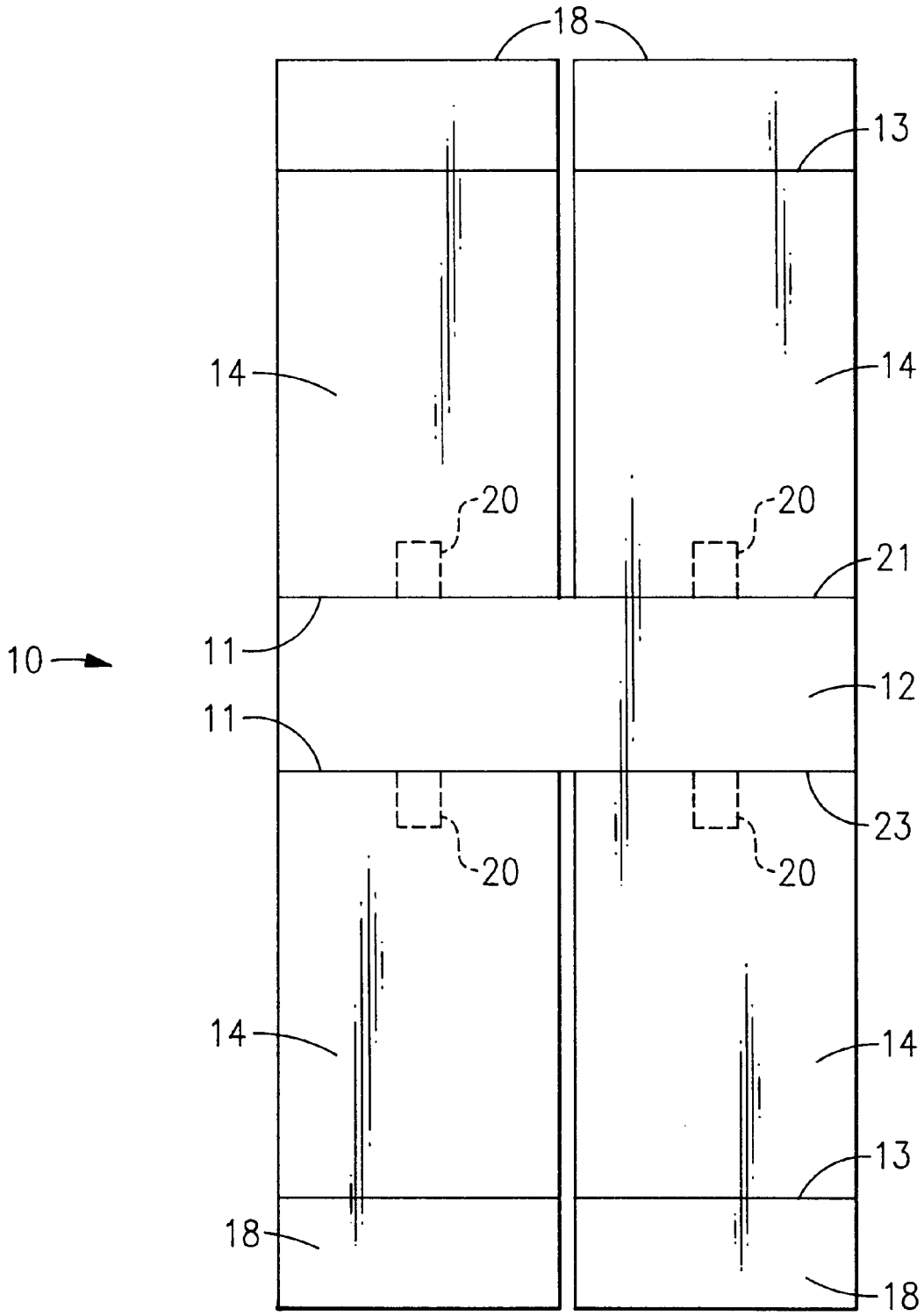
FIG. 2 is a side elevational view of the cosmetic holder assembly shown in FIG. 1.

Referring now in detail to the drawings, and in particular FIGS. 1 and 2 thereof, a novel cosmetic holder assembly embodying the present invention, generally designated by reference number 10, is therein illustrated which includes a rectangularly shaped support member or base 12 for detachably supporting a plurality of rectangularly shaped containers 14. Each containers 14 has an outer end portion 13 defining an access opening which is typically provided with a removable cap 18 which both encloses outer end portion 13 and access opening and facilitates dispensing of a cosmetic housed within the container 14 (not shown), as will be described in greater detail below.

Figure 3:
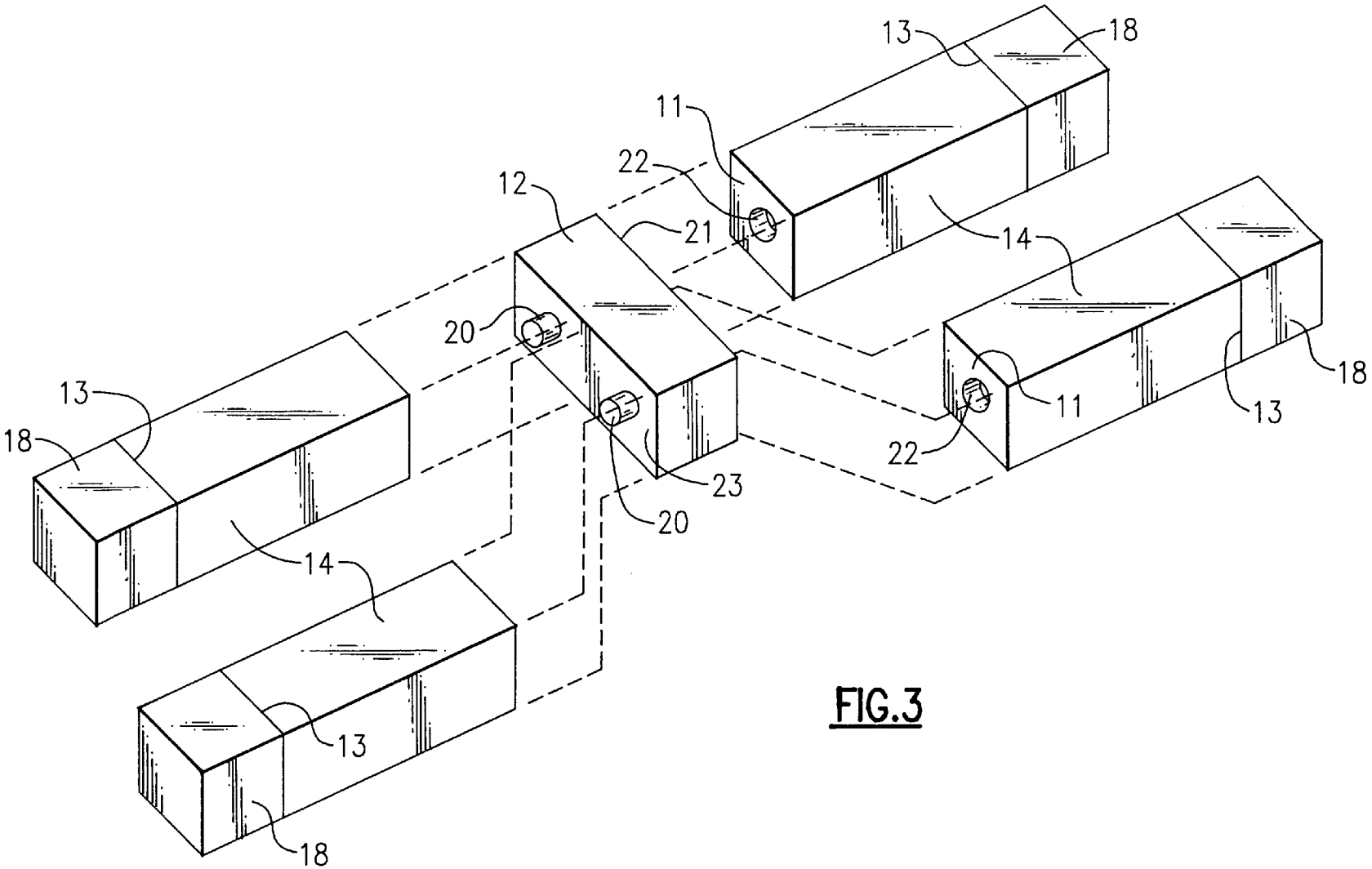
FIG. 3 is an exploded perspective view of the cosmetic holder assembly shown in FIG. 1.

As seen best in FIGS. 2 and 3, the base 12 has at least two spaced-apart upright cylindrical posts or projections 20 which extend from both of its opposed top and bottom surfaces 21 and 23, respectively. The posts 20 are dimensioned and configured for frictional engagement within a complimentary configured and dimensioned recess or bore 22 formed within the base surface 11 of each one of the corresponding containers 14. If desired, each post or projection 20 may be provided with a detent or a detent cavity while each recess or bore 22 may be provided with a mating detent cavity or a detent to facilitate a more secure attachment between the posts or projections 20 and the recesses or bores 22.

Figure 4:
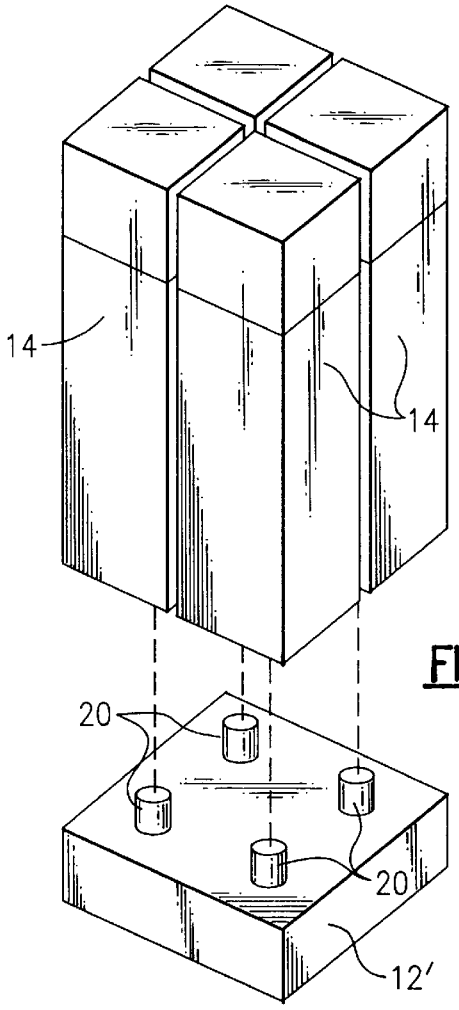
FIG. 4 is an exploded perspective view of another embodiment of the present invention.
Figure 5:
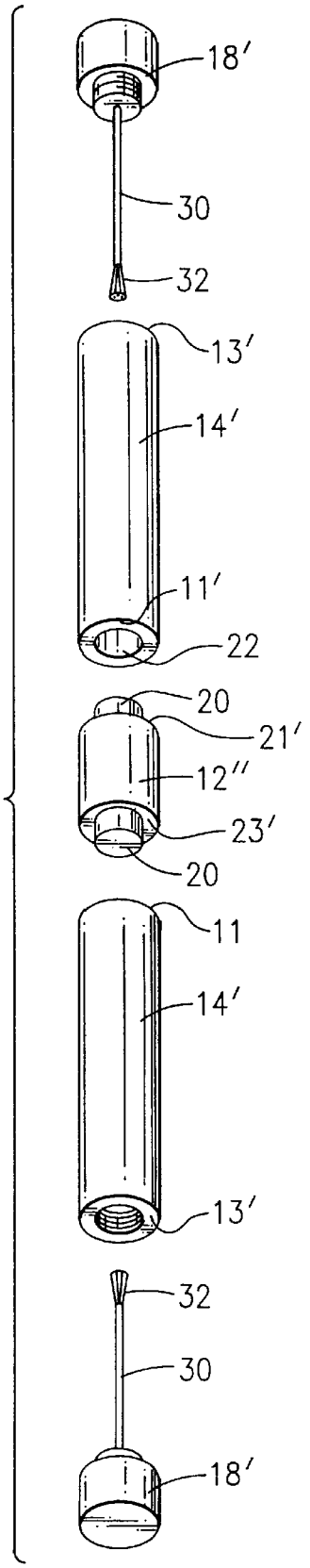
FIG. 5 is an exploded view of yet another alternative embodiment of the present invention.

As shown in FIG. 4, instead of a rectangularly shaped base 12, a square-shaped base 12' may utilized provided for supporting four separate cosmetic containers 14 on a first top surface of the base 12'. Alternatively, as shown in FIG. 5, instead of the rectangularly shaped base 12 and the rectangularly shaped containers 14, a cylindrically shaped base 12" and cylindrically-shaped containers 14' may be utilized. The square base 12" has four upright cylindrical posts or projections 20 extending from at least its top surface 21' and possibly from both opposed surfaces 21' and 23' thereof. Each post or projection 20 is releasably receivable and engageable, in a friction-fit manner, within a mating recess or bore 22 formed within the base surface 11' of the corresponding cylindrically shaped container 14'.

As further shown in FIG. 5, each cylindrically shaped container 14' has an internally threaded outer end portion 13' which is provided with an internally thread threadably sized to engage with an external threaded formed on the mating cap 18'. In addition, the cap 18' also supports or is formed integral with an applicator 30. The applicator 30 comprised a shaft 31 securely attached, at one end thereof, to the cap 18' and supporting a brush 32 at an opposite end thereof for dispensing mascara, eyeliner, nail polish, etc., which can be accommodated or housed within container 14'. The brush 32 may have a variety of different shapes, sizes and configurations to provide an ease of application of the particular cosmetic accommodated or housed within the container 14'.

Figure 6:
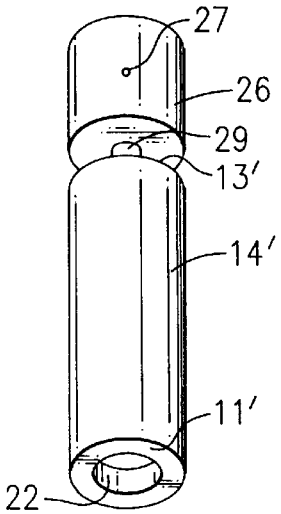
FIG. 6 is an enlarged perspective view of a spray-pump type container according to the present invention.
Figure 7:
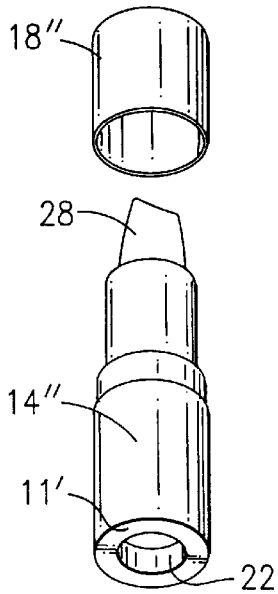
FIG. 7 is an enlarged exploded perspective view of a lipstick container according to the present invention.
Figure 8:
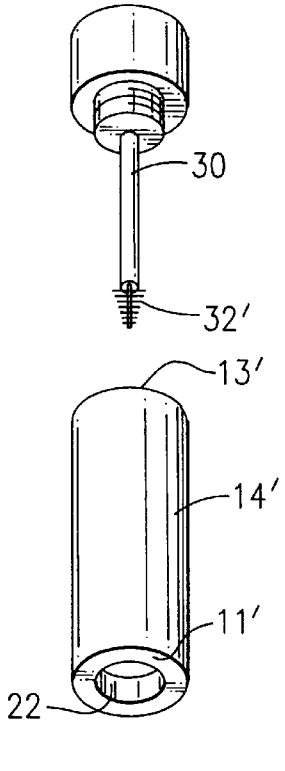
FIG. 8 is an enlarged exploded perspective view of an eyeliner container and applicator according to the present invention.

With reference to FIGS. 6–8, further embodiments of several different types of containers and caps, which may be utilized, are illustrated. FIG. 6 illustrates a spray-pump type container 14' for dispensing a perfume, a cologne, or a small quantity of some other housed liquid. The cylindrically-shaped container 14', accommodating or housing the perfume or cologne, for example, is connected to a conventional spray pump 26 having a hollow tubular stem 29 communicating with the liquid to facilitate dispensing of the product from the container. A spray pump 26, having a dispensing orifice 27 from which the perfume or cologne is sprayed when spray pump 26 is depressed, is coupled to the remote end of the tubular stem 29. As such dispensing arrangement is conventional and well known in the art, a further detail discussion concerning the same is not provided.

FIG. 7 illustrates a lipstick container 14". A conventional lipstick dispensing mechanism (not shown in detail) is supported within container 14'. Rotation of the container base, relative to a remainder of the container 14', allows the lipstick 28 to be extended out of for dispensing or retracted within the container 14" for storage. An elongated cap 18" is received over the container 14" in a friction-fit manner to cover and protect the lipstick 28.

FIG. 8 illustrates a container 14' for housing mascara or eyeliner, as shown in FIG. 5. Instead of a brush 32 for general use, a conventional curved shaped brush head 32' is employed.

Figure 9:
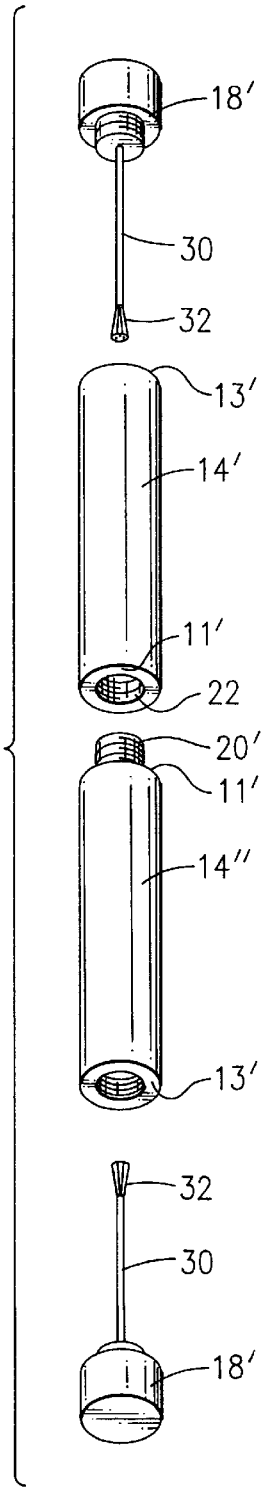
FIG. 9 is an exploded view of still another alternative embodiment of the present invention.

With reference to FIG. 9, a further embodiment of the present invention will now be briefly discussed. The variation of this embodiment completely eliminates the base member. According to this embodiment, a base surface of one container 14' is provided with the complimentary recess or bore 22 while a base of a second mating container 14" is provided with a mating post or projection 20' to facilitate direct engagement of the first container 14' to the second container 14" thereby eliminating the need to employ the base member 12. It is to be appreciated that this embodiment is useful in joining two containers 14', 14" directly with one another in an end to end based relationship to form a pair of axially aligned containers.

Figure 10:
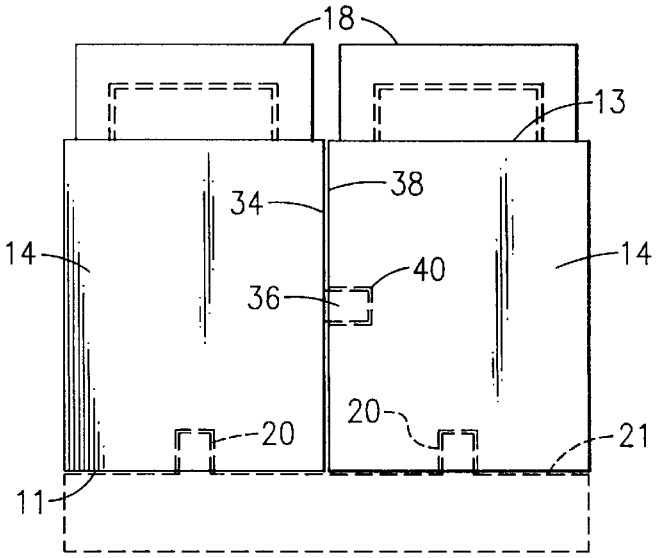
FIG. 10 is a side elevational view of another variation of the cosmetic holder according to the present invention.

With reference to FIG. 10, a still further embodiment of the present invention will be briefly described. This embodiment is very similar to the embodiment of FIG. 2 except that each container 14 is also provided with an interconnecting arrangement for coupling the adjacent and abutting sidewalls of the containers with one another. As be seen in FIG. 10, at least one sidewall 34 of each container 14 is provided with extra upstanding post or projection 36 while a mating sidewall 38 of an adjacent container 14 is provided with a mating recess or bore 40. Each post or bore 40 has a slight interference or friction fit with the mating recess or bore 36 or 40 to facilitate a secure attachment of the two containers with one another. It is to be appreciated that a number of sidewalls of one container can be releasable attached in a similar manner to a number of different containers to form a nest arrangement. Further, the post, projections, recess and/or bores, provided in the sidewalls of the containers 14, can be used in combination with the base 12 or can be utilized solely by themselves.

It is to be appreciated that various modifications may be made to the present invention and such modifications will be apparent to those skilled in the art. For example, although FIGS. 1–8 show either generally cylindrically or rectangularly shaped containers, caps and bases, they may have other polygonal shapes, e.g. be triangularly shaped, hexagonally shaped, octagonally shaped, etc., to suit the particular application. Consequently, the cosmetic holder assembly of the present invention can have a variety of different shapes and sizes. In addition, the location of the posts, projections, recesses and bores may be reversed, i.e. the posts or projections may be extended from the bottom end of the containers and the complementary recesses or bores may be formed within the surface of the base. Alternatively, other conventional and/or known quick release frictional, mechanical, magnetic or other mating coupling arrangements, e.g. threadable engagement means, Velcro® releasable fasteners, cooperating magnets, etc., may be employed in place of the post and bore friction-fit engagement means.

It is to be appreciated that the base 12" (see FIG. 5) can be a substantially planar, e.g. wafer thin, member having a post 20 extending from both substantially planar surfaces thereof. The condensed arrangement of this base facilitates a more compact interconnection of the two containers with one another.

Thus, while only several embodiments of the present invention have been illustrated and described, it will be appreciated to those skilled in the art that many changes and modifications may be made thereunto without departing from the spirit and scope of the invention as disclosed herein.

What is claimed is:

1. A cosmetic holder assembly for detachably supporting a plurality of separate cosmetic containers, said cosmetic holder assembly comprising:

a plurality of separate containers each having an internal cavity sized for housing a desired cosmetic therein, and each cavity being closed at one end and having an access opening at an opposite end thereof;

each of said plurality of separate containers having a removable cap for releasably engaging with the opening for sealing the desired cosmetic within the cavity and facilitating dispensing of the desired cosmetic contained therein when necessary;

a base having a pair of opposed flat planar surfaces, and at least one of said pair of opposed flat planar surfaces carrying a first component of a coupling member; and an exterior surface of each of said plurality of containers, adjacent the closed end of the container, having a second mating component of a coupling member for mating with the first component of the coupling member carried by the base to facilitate releasable coupling of each of said plurality of separate containers with the base.

2. The cosmetic holder assembly according to claim 1, wherein the second mating component of the coupling member comprises a recess formed in a bottom surface of each of said plurality of containers and the first component of the coupling member comprises a mating protrusion formed on one of the pair of opposed flat planar surfaces.

3. The cosmetic holder assembly according to claim 1, wherein the second mating component of the coupling member comprises a recess formed in a bottom surface of each of said plurality of containers and the first component of the coupling member comprises a plurality of mating protrusions formed on both of the pair of opposed flat planar surfaces.

4. The cosmetic holder according to claim 1, wherein side walls of the base are generally rectangular in shape and the pair of opposed flat planar surfaces are located at opposed ends of the side walls.

5. The cosmetic holder according to claim 1, wherein side wall of the base is generally circular in shape the pair of opposed flat planar surfaces are located at opposed ends of the side wall.

6. The cosmetic holder according to claim 1, wherein at least one side wall surface one of each of said plurality of separate containers is provided with a coupling member to facilitate coupling said one of said plurality of separate containers with a coupling member carried by a side wall of another one of said plurality of separate containers in a side by side engagement.

7. The cosmetic holder assembly according to claim 1, wherein at least one of said plurality of separate containers has a generally rectangular transverse cross section.

8. The cosmetic holder assembly according to claim 1, wherein at least one of said plurality of separate containers has a generally cylindrical transverse cross section.

9. The cosmetic holder assembly according to claim 1, wherein at least one of said removable caps has an internal thread and a perimeter of the opening of at least one of said plurality of separate containers has a mating exterior thread to facilitate threaded engagement therewith.

10. The cosmetic holder assembly according to claim 1, wherein said removable cap is a spray pump, with a hollow tubular stem communicating with the an desired cosmetic stored within the cavity, for dispensing the desired cosmetic from the cavity of said container.

11. The cosmetic holder assembly according to claim 4, wherein the rectangular shaped base carries at least four first components of the coupling member, and the at least four first components of the coupling member are all located on one and the same surface of the base.

12. The cosmetic holder assembly according to claim 1, wherein the base carries at least two first components of the coupling member on a first opposed flat planar surface thereof and the base carries two additional first components of the coupling member on an opposed second flat planar surface thereof.

13. The cosmetic holder assembly according to claim 1, wherein at least one of the removable caps comprises an applicator having a shaft attached thereto and the end of the shaft, remote from the applicator, supports a brush for dispensing the desired cosmetic from the cavity of said container.

14. The cosmetic holder assembly according to claim 13, wherein the brush for dispensing the desired cosmetic from the cavity of said container is a curved brush.

15. The cosmetic holder assembly according to claim 1, wherein first mating component of the coupling member is provided with one of a detent and a detent cavity and the second component of the coupling member is provided with the other of a detent and a detent cavity.

16. The cosmetic holder assembly according to claim 1, wherein first mating component of the coupling member mates with the second component of the coupling member in a friction fit manner.

17. A cosmetic holder assembly for detachably supporting a plurality of separate cosmetic containers, said cosmetic holder assembly comprising:

a plurality of separate containers each having an internal cavity sized for housing a desired cosmetic therein, and each cavity being closed at one end and having an access opening at an opposite end thereof;

each of said plurality of separate containers having a removable cap for releasably engaging with the opening for sealing the desired cosmetic within the cavity and facilitating dispensing of the desired cosmetic contained therein when necessary;

a base having a pair of opposed flat planar surfaces, and at least one of said pair of opposed flat planar surfaces carrying a first component of a coupling member;

an exterior surface of each of said plurality of containers, adjacent the closed end of the container, having a second mating component of a coupling member for mating with the first component of the coupling member carried by the base to facilitate releasable coupling of each of said plurality of separate containers with the base;

the base carries at least one first component of the coupling member on a first opposed flat planar surface thereof and the base carries an additional first component of the coupling member on an opposed second flat planar surface thereof; and at least one removable cap has an internal thread and a perimeter of the opening of at least one of said plurality of separate containers has a mating exterior thread to facilitate threaded engagement therewith.

18. The cosmetic holder assembly according to claim 17, wherein first mating component of the coupling member is provided with one of a detent and a detent cavity and the second component of the coupling member is provided with the other of a detent and a detent cavity.

19. A cosmetic holder assembly for detachably supporting a plurality of separate cosmetic containers, said cosmetic holder assembly comprising:

a plurality of separate containers each having an internal cavity sized for housing a desired cosmetic therein, and each cavity being closed at one end and having an access opening at an opposite end thereof;

each of said plurality of separate containers having a removable cap for releasably engaging with the opening for sealing the desired cosmetic within the cavity and facilitating dispensing of the desired cosmetic contained therein when necessary;

a base having a pair of opposed flat planar surfaces, and at least one of said pair of opposed flat planar surfaces carrying a first component of a coupling member;

an exterior surface of each of said plurality of containers, adjacent the closed end of the container, having a second mating component of a coupling member for mating with the first component of the coupling member carried by the base to facilitate releasable coupling of each of said plurality of separate containers with the base;

the base carries at least two first components of the coupling member on a first opposed flat planar surface thereof and the base carries two additional first components of the coupling member on an opposed second flat planar surface thereof; and at least one side wall surface one of each of said plurality of separate containers is provided with a coupling member to facilitate coupling said one of said plurality of separate containers with a coupling member carried by a side wall of another one of said plurality of separate containers in a side by side engagement.

20. The cosmetic holder assembly according to claim 19, wherein first mating component of the coupling member is provided with one of a detent and a detent cavity and the second component of the coupling member is provided with the other of a detent and a detent cavity.

* * * * *